US009388651B2

(12) United States Patent
Hradecky

(10) Patent No.: US 9,388,651 B2
(45) Date of Patent: Jul. 12, 2016

(54) ELECTROMAGNETICALLY ACTIVATED JARRING

(71) Applicant: Impact Selector, Inc., Heath, TX (US)

(72) Inventor: Jason Allen Hradecky, The Woodlands, TX (US)

(73) Assignee: Impact Selector International, LLC, Houma, LA (US)

( * ) Notice: Subject to any disclaimer, the term of this patent is extended or adjusted under 35 U.S.C. 154(b) by 359 days.

(21) Appl. No.: 14/157,949

(22) Filed: Jan. 17, 2014

(65) Prior Publication Data

US 2014/0196911 A1 Jul. 17, 2014

Related U.S. Application Data

(60) Provisional application No. 61/753,722, filed on Jan. 17, 2013.

(51) Int. Cl.
*E21B 31/06* (2006.01)
*E21B 31/107* (2006.01)

(52) U.S. Cl.
CPC ..... *E21B 31/107* (2013.01)

(58) Field of Classification Search
CPC ..... E21B 31/106; E21B 31/107; E21B 23/00
USPC ..... 166/178, 301, 66.5; 175/105, 293; 173/103
See application file for complete search history.

(56) References Cited

U.S. PATENT DOCUMENTS 7,267,176 B2 * 9/2007 Madden ..... E21B 31/107 166/178
8,499,836 B2 * 8/2013 Moriarty ..... E21B 31/107 166/178

* cited by examiner

*Primary Examiner* — Kenneth L Thompson
(74) *Attorney, Agent, or Firm* — Boisbrun Hofman, PLLC

(57) ABSTRACT

An impact apparatus conveyable in a tool string within a wellbore comprises a mandrel, a first impact feature, and a latch pin retainer encircling an end of the mandrel. A release sleeve encircles a portion of the latch pin retainer and includes a radial recess. Latch pins retained by the latch pin retainer are slidable into and out of the radial recess, and prevent disengagement of the mandrel end from the latch pin retainer when not extending into the radial recess. A release member electromagnetically causes relative translation of the latch pin retainer and the release sleeve, including aligning the latch pins with the radial recess and thereby permitting the disengagement. A second impact feature is positioned to impact the first impact feature in response to the disengagement when the impact apparatus is under tension.

20 Claims, 12 Drawing Sheets

ELECTROMAGNETICALLY ACTIVATED JARRING

CROSS-REFERENCE TO RELATED APPLICATIONS

This application claims priority to and the benefit of U.S. Provisional Application No. 61/753,722, entitled "ELECTRONIC ACTIVATING JAR - ELECTRO-MAGNETIC RELEASE," filed Jan. 17, 2013, the entire disclosure of which is hereby incorporated herein by reference for all intents and purposes.

BACKGROUND OF THE DISCLOSURE

Drilling operations have become increasingly expensive in response to drilling in harsher environments through more difficult materials and/or deeper than previously possible. The cost and complexity of related downhole tools have, consequently, experienced similar increases. Furthermore, it thus follows that the risk associated with such operations and equipment has also grown. Accordingly, additional and more frequent precautionary steps are being utilized to insure or otherwise protect the related financial investments, as well as to mitigate the heightened risks.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
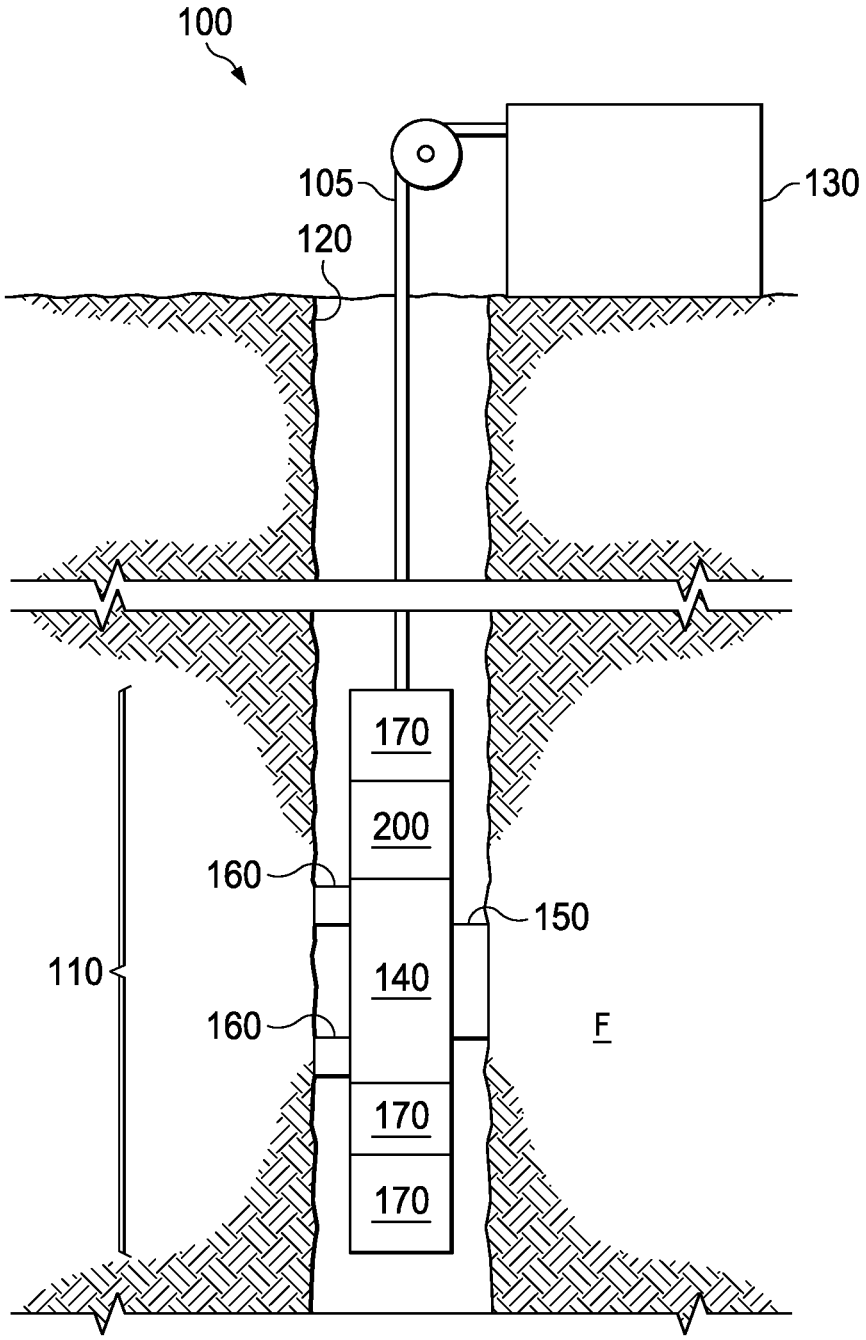
FIG. 1 is a sectional view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of an exemplary operating environment and/or system 100 within the scope of the present disclosure wherein a downhole tool 200 is suspended within a tool string 110 coupled to the end of a wireline, slickline, e-line, and/or other conveyance means 105 at a wellsite having a wellbore 120. The downhole tool 200, the tool string 110, and/or the conveyance means 105 may be structured, operated, and/or arranged with respect to a service vehicle and/or one or more other surface components at the wellsite, collectively referred to in FIG. 1 as surface equipment 130. The example system 100 may be utilized for various downhole operations including, without limitation, those for and/or related to completions, conveyance, drilling, formation evaluation, reservoir characterization, and/or production, among others.

For example, the tool string 110 may comprise a downhole tool 140 that may be utilized for testing a subterranean formation F and/or analyzing composition of one or more fluids within and/or obtained from the formation F. The downhole tool 140 may comprise an elongated body encasing and/or coupled to a variety of electronic components and/or modules that may be operable to provide predetermined functionality to the downhole tool 140. For example, the downhole tool 140 may comprise one or more static or selectively extendible apparatus 150 operable to interact with the sidewall of the wellbore 120 and/or the formation F, as well as one or more selectively extendible anchoring members 160 opposite the apparatus 150. The apparatus 150 may be operable to perform and/or be utilized for logging, testing, sampling, and/or other operations associated with the formation F, the wellbore 120, and/or fluids therein. For example, the apparatus 150 may be operable to selectively seal off or isolate one or more portions of the sidewall of the wellbore 120 such that pressure or fluid communication with the adjacent formation F may be established, such as where the apparatus 150 may be or comprise one or more probes, packers, probe modules, and/or packer modules.

The downhole tool 140 may be directly or indirectly coupled to the downhole tool 200 and/or other downhole tools 170 forming the tool string 110. Relative to the example implementation depicted in FIG. 1, the tool string 110 may comprise additional and/or alternative components within the scope of the present disclosure. The tool string 110, the surface equipment 130, and/or other portion(s) of the system 100 may also comprise associated telemetry/control devices/electronics and/or control/communication equipment.

Figure 2:
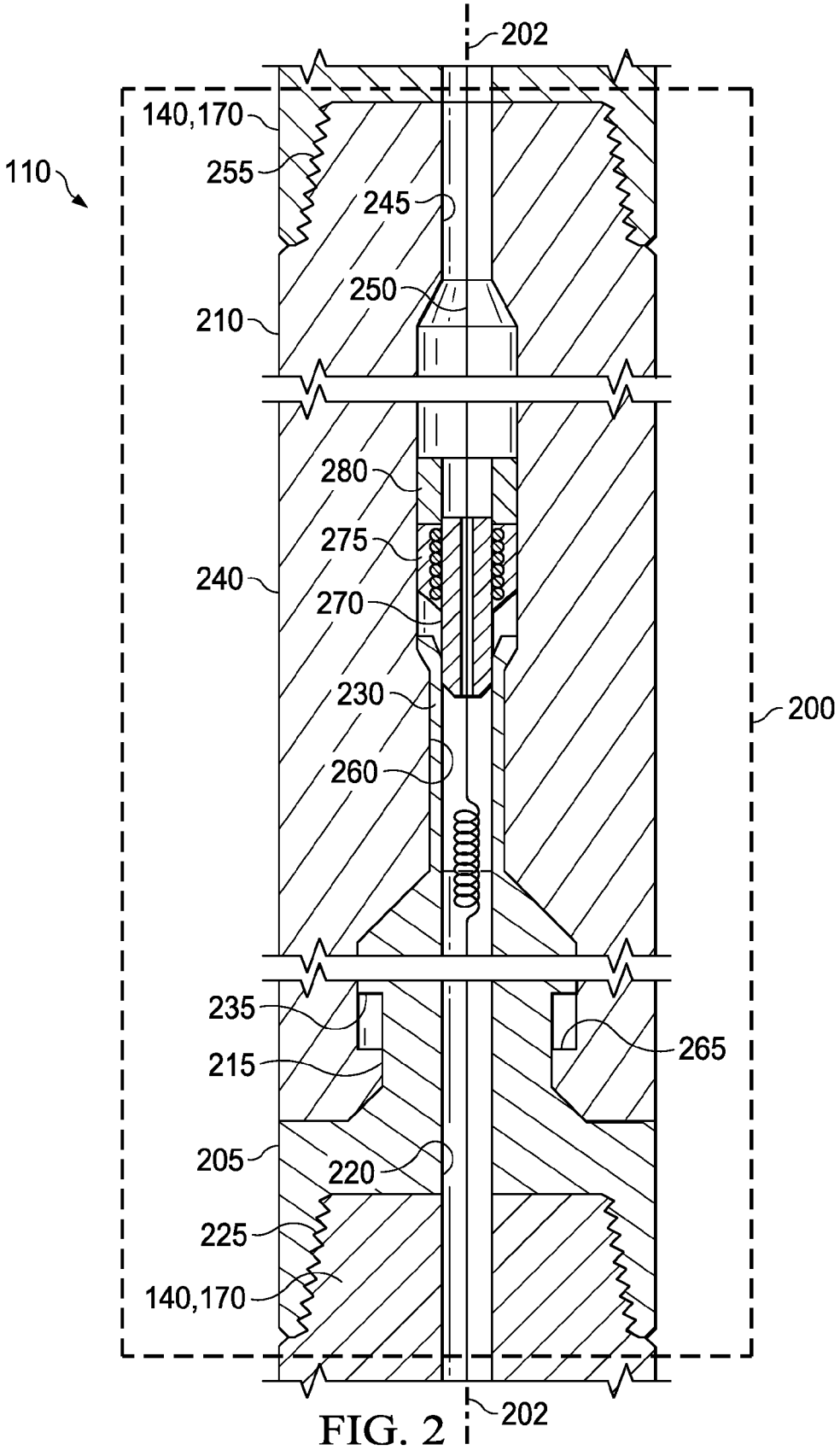
FIG. 2 is a sectional view of at least a portion of the apparatus shown in FIG. 1 according to one or more aspects of the present disclosure.
Figure 3:
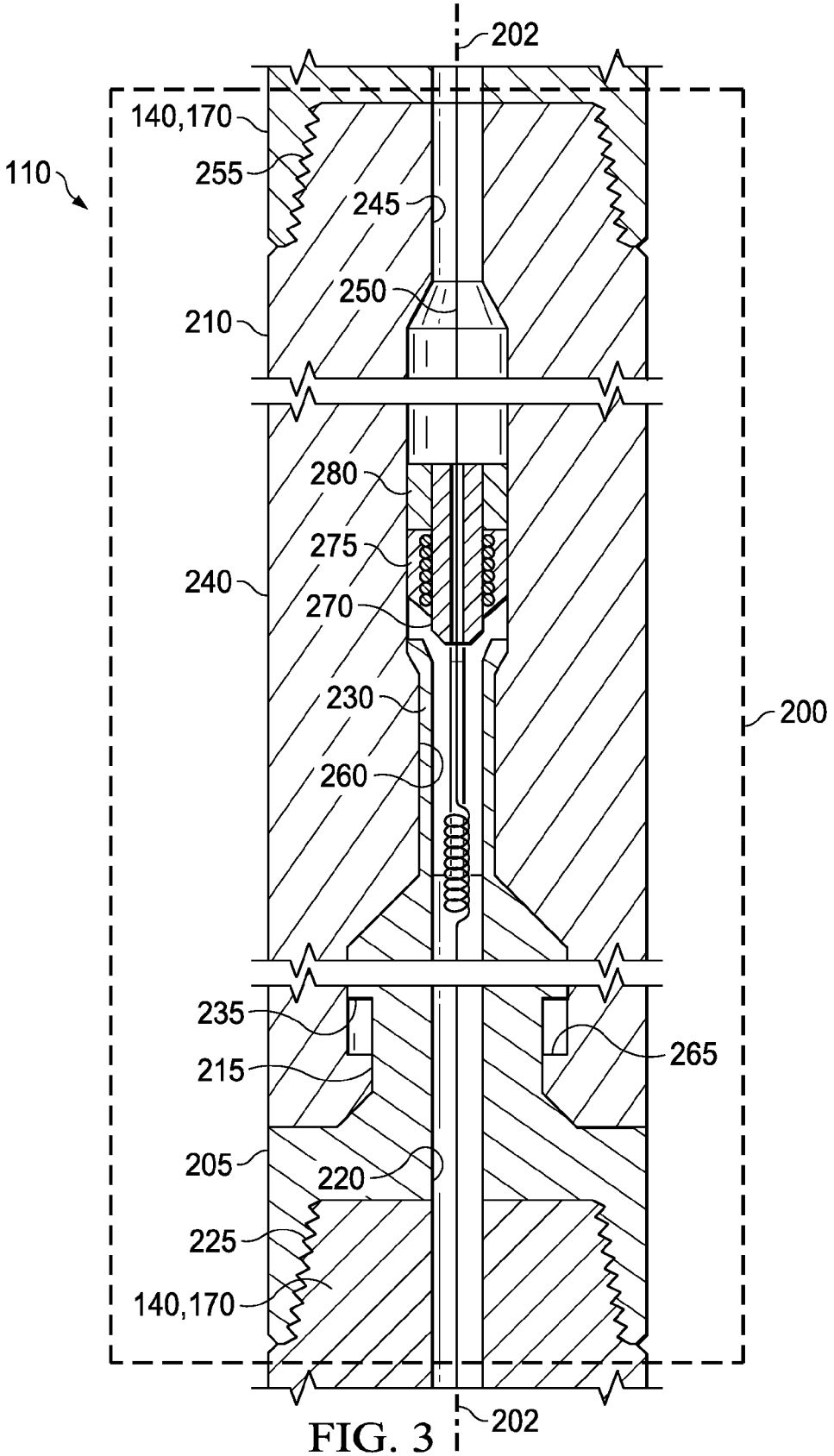
FIG. 3 is a sectional view of the apparatus shown in FIG. 2 in a subsequent stage of operation according to one or more aspects of the present disclosure.
Figure 4:
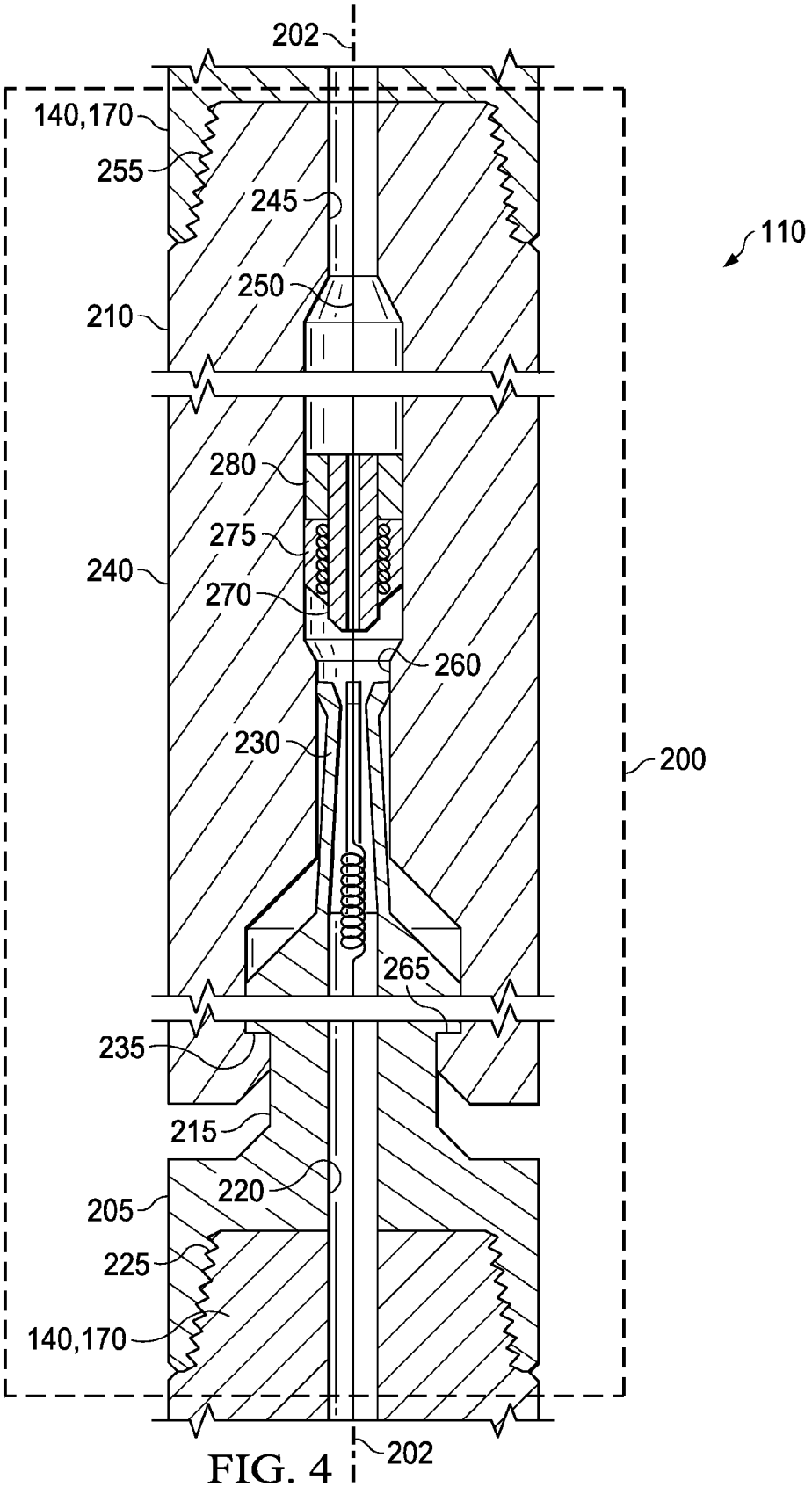
FIG. 4 is a sectional view of the apparatus shown in FIG. 3 in a subsequent stage of operation according to one or more aspects of the present disclosure.
Figure 5:
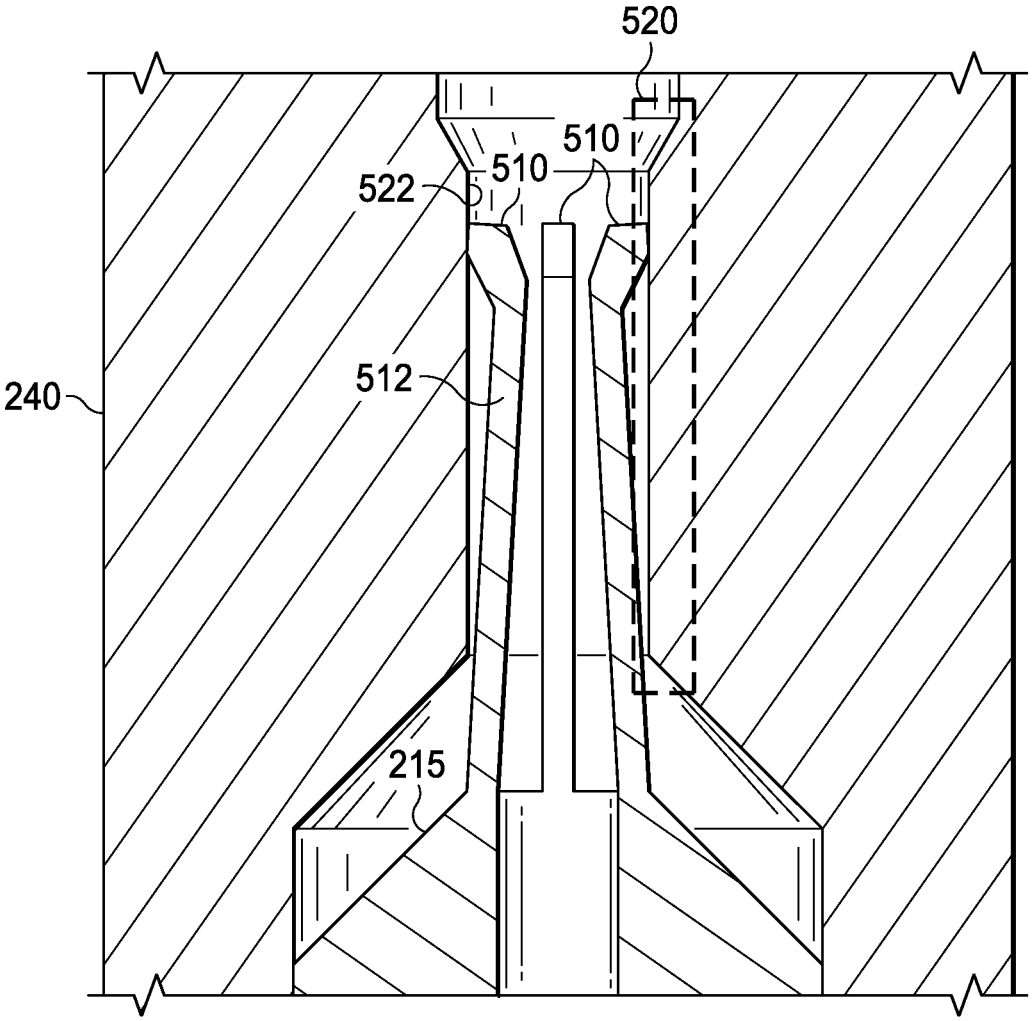
FIG. 5 is a sectional view of a portion of the apparatus shown in FIG. 1 according to one or more aspects of the present disclosure.
Figure 6:
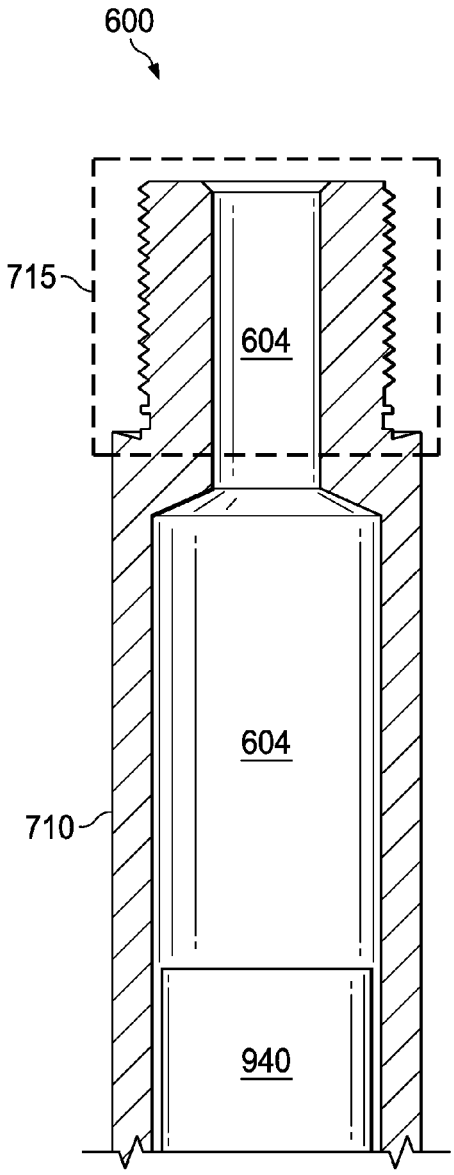
FIG. 6 is a sectional view of a portion of the apparatus shown in FIG. 1 according to one or more aspects of the present disclosure.

The downhole tool 200 is or comprises an impact apparatus operable to impart an impart force to at least a portion of the tool string 110 in the event the tool string 110 becomes lodged in the wellbore 120. FIG. 2 is a sectional view of different axial portions of the downhole tool 200, as well as other portions of the tool string 110. Similarly, FIGS. 3 and 4 are sectional views of the downhole tool 200 but in different stages of operation. FIG. 5 is an enlarged view of a portion of FIG. 4. The following description refers to FIGS. 2-5, collectively, unless otherwise specified.

The downhole tool 200 comprises a first portion 205 and a second portion 210 that are slidably engaged with one another. A body 215 of the first portion 205 may substantially comprise one or more metallic and/or other substantially rigid members collectively having a central passage 220. The body 215 may have a shape resembling a pipe, tube, or conduit, such as may be substantially cylindrical and/or substantially annular.

An end of the body 215 may comprise an interface 225 for coupling with another component of the tool string 110, such as one of the downhole tools 140 and/or 170 shown in FIG. 1. The interface 225 may threadedly couple with the other component of the tool string 110, although other types of couplings are also within the scope of the present disclosure. The end of the body 215 comprising the interface 225 may be flanged or otherwise be greater in cross-sectional diameter relative to the remainder of the body 215.

The other end of the body 215 carries a first engagement feature 230. The first engagement feature 230 may be formed integral to the body 215, or may be a discrete component or subassembly coupled to the body 215 by threaded fastening means, interference fit, and/or other coupling means.

The first portion 205 of the downhole tool 200 also comprises an impact feature 235. For example, in the example implementation depicted in FIG. 2, the impact feature 235 is a shoulder that is integral to the body 215 and substantially perpendicular to the longitudinal axis 202 of the downhole tool. However, a discrete member coupled to the body 215 by threaded fastening means, interference fit, and/or other coupling means may also or alternatively form the shoulder and/or other type of impact feature 235.

A body 240 of the second portion 210 may substantially comprise one or more metallic and/or other substantially rigid members. The body 240 may have a central passage 245 that is substantially coaxial and/or otherwise aligned and/or in physical communication with the central passage(s) 220 of the first portion 205. As such, one or more wires and/or other conductors 250 may extend through the first portion 205, the second portion 210, and components thereof, such that an electrical signal transmitted from surface to the tool string may pass through the downhole tool 200 to lower components of the tool string. The body 240 may have a shape resembling a pipe, tube, or conduit, such as may be substantially cylindrical and/or substantially annular.

An end of the body 240 may comprise an interface 255 for coupling with another component of the tool string 110, such as one of the downhole tools 140 and/or 170 shown in FIG. 1. The interface 255 may threadedly couple with the other component of the tool string 110, although other types of couplings are also within the scope of the present disclosure.

The body 240 carries a second engagement feature 260, which may be integral to the body 240 or a discrete component or subassembly coupled to the body 240 by threaded fastening means, interference fit, and/or other coupling means. The second engagement feature 260 is depicted in FIG. 2 as being engaged with the first engagement feature 230. Such engagement is selectable, as described below.

The second portion 210 of the downhole tool 200 also comprises an impact feature 265. For example, in the example implementation depicted in FIG. 2, the impact feature 265 is a shoulder that is integral to the body 240 and substantially perpendicular to the longitudinal axis 202 of the downhole tool. However, a discrete member coupled to the body 240 by threaded fastening means, interference fit, and/or other coupling means may also or alternatively form the shoulder and/or other type of impact feature 265.

The body 240 also carries a release member 270. The release member 270 is repositionable between a first position, shown in FIG. 2, and a second position, shown in FIGS. 3 and 4. Such repositioning is in response to an electronic signal carried by the conveyance means 105 (FIG. 1). For example, the first electronic signal transmitted from surface to the downhole tool 200 via the conveyance means 105 may initiate the repositioning of the release member 270 from the first position towards or to the second position, and a second electronic signal transmitted from surface to the downhole tool 200 via the conveyance means 105 may initiate the repositioning of the release member 270 from the second position towards or to the first position.

As mentioned above, the engagement of the first and second engagement features 230 and 260 may be selective, selectable, or otherwise adjustable. That is, the release member 270 prevents disengagement of the first and second engagement features 230 and 260 when in the first position (FIG. 2), but not when in the second position (FIGS. 3 and 4). By selectively transmitting predetermined signals to the downhole tool 200 via the conveyance means 105, the release member 270 may be repositioned between the first and second positions, thus selectively permitting or preventing the disengagement of the first and second engaging features 230 and 260.

As best shown in FIG. 5, the first engagement feature 230 may comprise a plurality of longitudinal, cantilevered fingers and/or other flexible members 510, such as may form a collet and/or other type of latching mechanism. The second engagement feature 260 may comprise or be an inward-protruding portion 520 of the body 240. Each flexible member 510 may have an exterior profile 512 that corresponds to an interior profile 522 of the inward-protruding portion 520. Thus, as shown in FIGS. 2 and 3, the exterior profile 512 of each flexible member 510 may be mated with or otherwise be in engagement with the interior profile 522 of the inward-protruding portion 520 of the body 240. Thus, FIGS. 2 and 3 depict an example implementation in which the first and second engagement features 230 and 260 are engaged, and FIGS. 4 and 5 depict the example implementation in which the first and second engagement features 230 and 260 are disengaged.

Returning to FIG. 2, when the first and second engagement features 230 and 260 are engaged, and the release member 270 is in the first position, an end of the release member 270 interposes ends of the flexible members 510 of the first engagement feature 230, such that contact between an outer surface of the release member 270 and an inner surface of the flexible members 510 prevents disengagement of the first engagement feature 230 from the second engagement feature 260. That is, the positioning of the release member 270 within the first engagement feature 230 prevents the inward deflection of the ends of the flexible members 510, thus preventing the axial separation of the first and second portions 205 and 210 of the downhole tool 200.

However, as shown in FIG. 3, when the release member 270 is repositioned to the second position, such that the release member 270 no longer protrudes into the first engagement feature 230, the release member 270 does not prevent disengagement of the first and second engagement features 230 and 260. Accordingly, a tensile force acting on the second portion 210 of the downhole tool 200, such as in response to a pull load applied to the downhole tool 200 and/or other portion of the tool string via the conveyance means 105, will disengage the first and second engagement features 230 and 260. Consequently, the first and second portions 205 and 210 of the downhole tool 200 will axially separate, as shown in FIG. 4.

Depending on the tensile force acting on the second portion 210 of the downhole tool 200, the axial separation of the first and second portions 205 and 210 may be quite rapid. However, the first and second impact features 235 and 265 will limit the axial separation when they impact one another. The force of the impact, which depends on the tensile force acting across the downhole tool 200, is then imparted to a remaining portion of the tool string, via the interface 225 and similar interfaces between components of the tool string below (i.e., deeper in the wellbore) the downhole tool 200.

The imparted impact force may be utilized to aid in dislodging a portion of the tool string that has become stuck in the wellbore. However, if the impact force fails to dislodge the stuck portion of the tool string, the downhole tool 200 may be reset. That is, the pull load applied to the downhole tool 200 and/or other portion of the tool string via the conveyance means 105 may be decreased, thus allowing the axial separation of the first and second portions 205 and 210 to decrease. The relative axial translation of the first and second engagement features 230 and 260 also axially displaces the release member 270 relative to the second portion 210. After a sufficient decrease of the axial separation of the first and second portions 205 and 210, the first and second engagement features 230 and 260 may reengage. Such reengagement decreases or eliminates the inward deflection of the ends of the flexible members 510 of the first engagement feature 230, thus permitting the release member 270 to once again be repositioned to the first position, as shown in FIG. 2. Such repositioning to the first position may be in response to an electronic signal transmitted via the conveyance means. Alternatively, or additionally, one or more springs and/or other mechanical and/or electrical biasing features may be utilized in the repositioning of the release member 270 to the first position.

As described above, the release member 270 may be translated between the first and second positions in response to the downhole tool 200 receiving an electronic signal sent from surface via the conveyance means 105. The second portion 210 of the downhole tool 200 may comprise or otherwise carry an actuator 275 operable to reposition the release member 270 between the first and second positions in response to the signal. In the example implementation shown in FIGS. 2-4, the actuator 275 is depicted as an electronic solenoid switch. However, the actuator 275 may alternatively or additionally comprise other electronic, magnetic, and/or electromagnetic devices.

The electronic signal may be transmitted from surface via the conveyance means 105 and the conductor 250 (and perhaps other intervening components of the tool string) to a receiver of the actuator 275 and/or other electronics 280 of the downhole tool 200. If such signal is transmitted to the downhole tool 200 for the purpose of triggering the downhole tool 200 to perform an impact, the downhole tool 200 may already be under tension as a result of a pull load being maintained at a predetermined threshold on the conveyance means 105 at surface. In such scenario, the signal received by the receiver of the actuator 275 and/or other electronics 280 of the downhole tool 200 may be to cause the actuator 275 and/or other component of the downhole tool 200 to axially translate the release member 270 towards or to the second position shown in FIG. 3, which in turn allows the rapid axial separation of the first and second portions 205 and 210 of the downhole tool to cause an impact, as shown in FIG. 4. Thereafter, the pull load may be decreased, allowing the reengagement of the first and second engagement features 230 and 260. A subsequent signal may then be transmitted to the downhole tool 200 to cause the actuator 275 and/or other component of the downhole tool 200 to axially translate the release member 270 towards or to the first position, shown in FIG. 2. This cycle may be repeated as necessary to dislodge the stuck portion of the tool string.

In some implementations, successive cycles may utilize a higher predetermined tension maintained by the pull load on the conveyance means 105 at surface, relative to previous cycles. For example, each successive cycle may utilize a predetermined tension that is about 10% higher than the immediately preceding cycle. However, other intervals are also within the scope of the present application, and multiple cycles may be performed at each predetermined tension level.

FIGS. 6-11 are sectional views of various axial portions of another example implementation of the downhole tool 200 shown in FIGS. 1-5, herein designated by reference numeral 600. The following description refers to FIGS. 1 and 6-11, collectively, unless otherwise specified.

As with the example implementation shown in FIGS. 2-5, the downhole tool 600 is or comprises an impact apparatus operable to impart an impart force to at least a portion of the tool string 110 in the event the tool string 110 becomes lodged in the wellbore 120. The downhole tool 600 comprises a first portion and a second portion that are slidably engaged with one another. From top to bottom, the first portion of the downhole tool 600 includes an upper housing 710 (spanning FIGS. 6 and 7), a housing connector 720 (FIG. 7) coupled to the upper housing 710, an intermediate housing 730 (spanning FIGS. 7 and 8) coupled to the a housing connector 720, a lower housing 740 (spanning FIGS. 8-10) coupled to the intermediate housing 730, and a terminating housing 750 (spanning FIGS. 9 and 10) coupled to the lower housing 740. The second portion of the downhole tool 600 includes, from top to bottom, a first engagement feature 810 (FIG. 7), a shaft 820 (spanning FIGS. 7-9) coupled to the first engagement feature 810, a mandrel 830 (spanning FIGS. 9 and 10) coupled to the shaft 820, and a lower joint connection 840 (spanning FIGS. 10 and 11) coupled to the mandrel 830.

The upper housing 710 may comprise an interface 715 for coupling with another component of the tool string 110, such as one of the downhole tools 140 and/or 170 shown in FIG. 1. The interface 715 may threadedly couple with the other component of the tool string 110, although other types of couplings are also within the scope of the present disclosure.

The lower joint connection 840 may comprise an interface 845 for coupling with another component of the tool string 110, such as one of the downhole tools 140 and/or 170 shown in FIG. 1. The interface 845 may threadedly couple with the other component of the tool string 110, although other types of couplings are also within the scope of the present disclosure.

Figure 7:
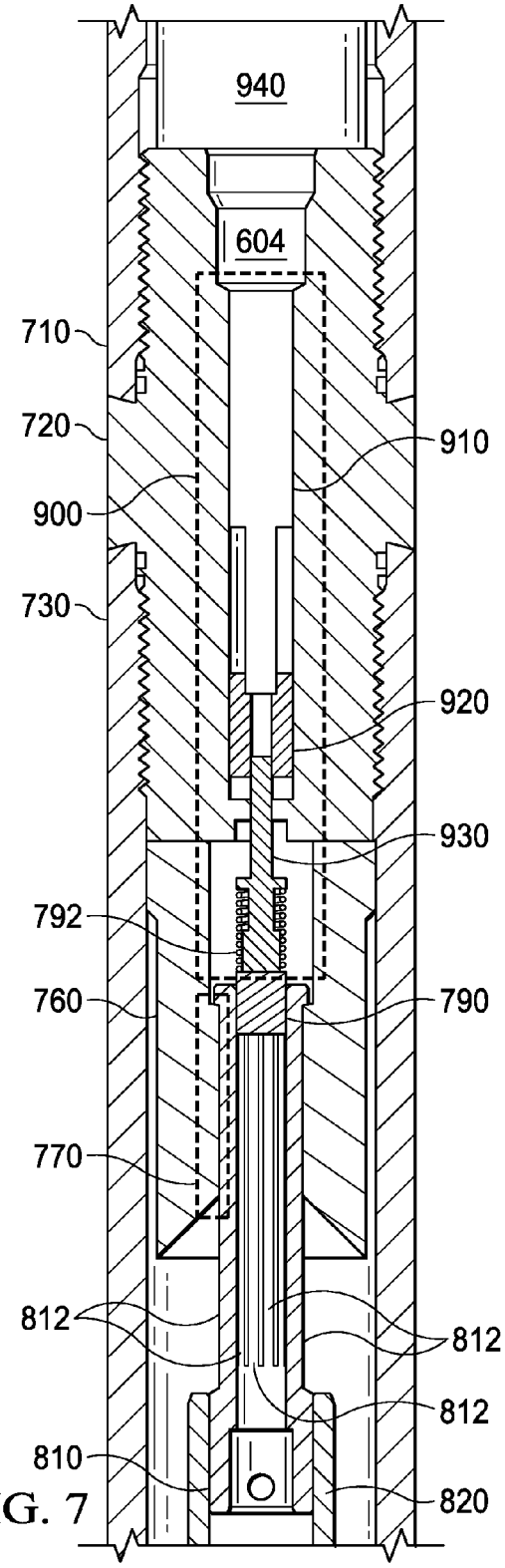
FIG. 7 is a sectional view of another portion of the apparatus shown in FIG. 6 according to one or more aspects of the present disclosure.
Figure 8:
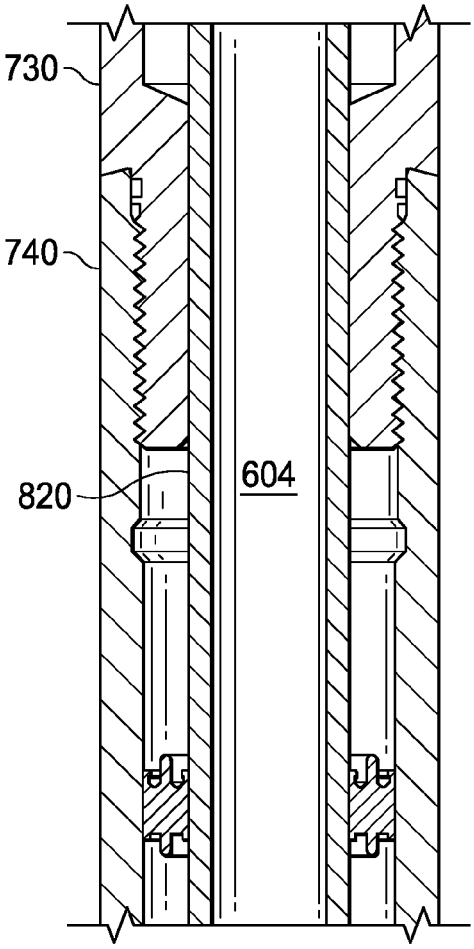
FIG. 8 is a sectional view of another portion of the apparatus shown in FIGS. 6 and 7 according to one or more aspects of the present disclosure.
Figure 9:
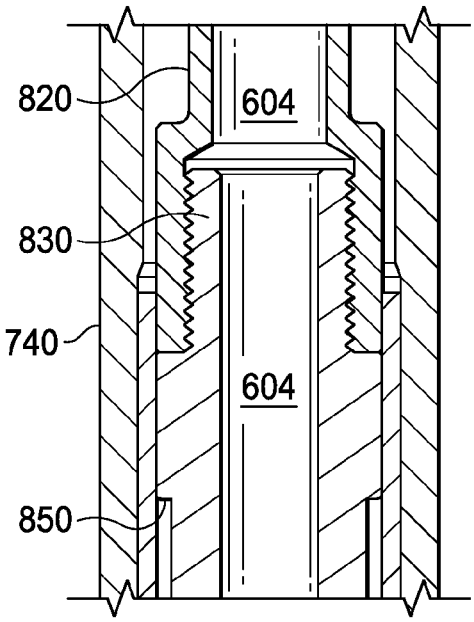
FIG. 9 is a sectional view of another portion of the apparatus shown in FIGS. 6-8 according to one or more aspects of the present disclosure.
Figure 10:
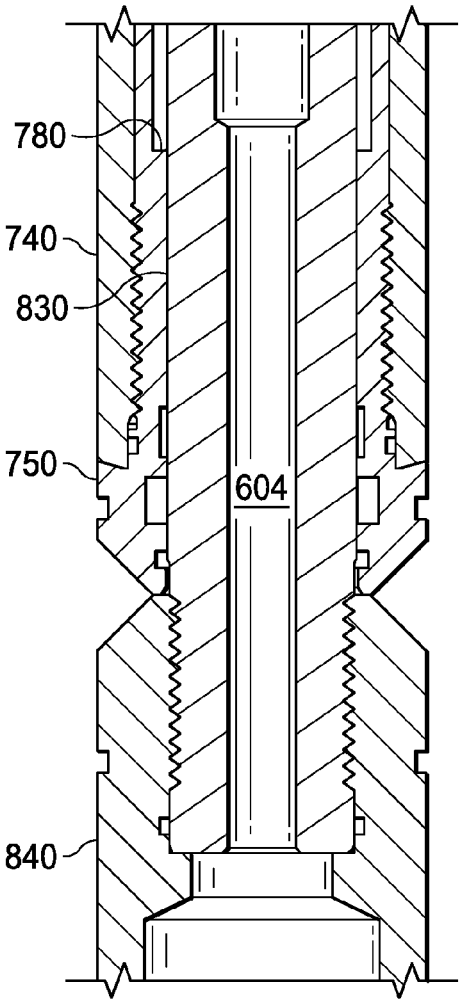
FIG. 10 is a sectional view of another portion of the apparatus shown in FIGS. 6-9 according to one or more aspects of the present disclosure.
Figure 11:
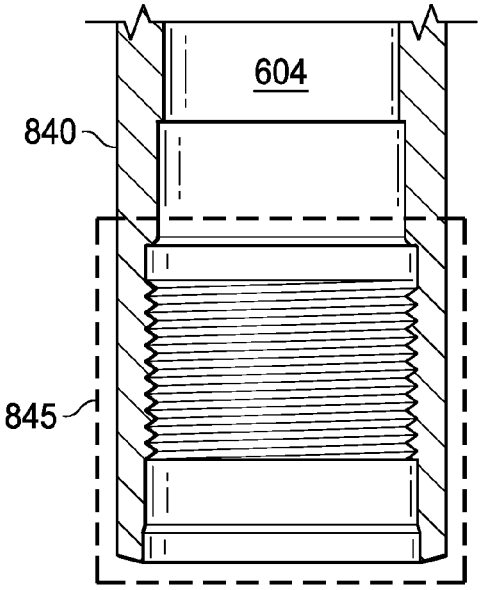
FIG. 11 is a sectional view of another portion of the apparatus shown in FIGS. 6-10 according to one or more aspects of the present disclosure.

A mandrel 760 (FIG. 7) carried by the housing connector 720 and/or the intermediate housing 730 may carry a second engagement feature 770. The second engagement feature 770 may be substantially similar to the second engagement feature 260 as described above and/or as shown in FIGS. 2-5, except perhaps as described below and/or as shown in FIG. 7. The second engagement feature 770 may comprise or be an inwardly protruding portion of the mandrel 760, and may thus form a portion of the inner profile of the mandrel 760.

The first engagement feature 810 may be integral to the shaft 820, or may be a discrete component or subassembly coupled to the shaft 820 by threaded fastening means, interference fit, and/or other coupling means. The first engagement feature 810 is depicted in FIG. 7 as being engaged with the second engagement feature 770. As with the example implementations described above, such engagement is selectable, selective, or otherwise adjustable.

The first portion of the downhole tool 600 also comprises an impact feature 780. For example, in the example implementation depicted in FIG. 10, the impact feature 780 is a shoulder that is integral to the terminating housing 750 and substantially perpendicular to the longitudinal axis 602 of the downhole tool. However, a discrete member coupled to the terminating housing 750 and/or another component of the first portion of the downhole tool 600, whether by threaded fastening means, interference fit, and/or other coupling means, may also or alternatively form the shoulder and/or other type of impact feature 780.

The second portion 210 of the downhole tool 200 also comprises an impact feature 850. For example, in the example implementation depicted in FIG. 9, the impact feature 850 is a shoulder that is integral to the mandrel 830 and substantially perpendicular to the longitudinal axis 602 of the downhole tool 600. However, a discrete member coupled to the mandrel 830 and/or another component of the second portion of the downhole tool 600, whether by threaded fastening means, interference fit, and/or other coupling means, may also or alternatively form the shoulder and/or other type of impact feature 850.

The mandrel 760 also carries a release member 790. The release member 790 is repositionable between a first position (shown in FIG. 7) and a second position (not shown). Such repositioning is in response to an electronic signal carried by the conveyance means 105 (FIG. 1). For example, the first electronic signal transmitted from surface to the downhole tool 600 via the conveyance means 105 may initiate the repositioning of the release member 790 from the first position towards or to the second position, and a second electronic signal transmitted from surface to the downhole tool 600 via the conveyance means 105 may initiate the repositioning of the release member 790 from the second position towards or to the first position. Transmission of such signals may include conduction along one or more conductive members similar to the conductive member(s) 250 described above. Such conductive members are omitted from the depictions in FIGS. 6-11, although merely for the sake of simplicity, as a person having ordinary skill in the art will readily understand that implementations of the downhole tool 600 within the scope of the present disclosure include such conductive members extending through the downhole tool 600. Similarly, the downhole tool 600 includes various central or otherwise internal passages 604 through which such conductive members extend, even though some of these passages may not be shown in FIGS. 6-11.

As mentioned above, the engagement of the first and second engagement features 810 and 770 may be selective, selectable, or otherwise adjustable. That is, the release member 790 prevents disengagement of the first and second engaging features 810 and 770 when in the first position, but not when in the second position. By selectively transmitting predetermined signals to the downhole tool 600 via the conveyance means 105, the release member 790 may be repositioned between the first and second positions, thus selectively permitting or preventing the disengagement of the first and second engaging features 810 and 770.

As shown in FIG. 7, the first engagement feature 810 may comprise a plurality of longitudinal, cantilevered fingers and/or other flexible members 812, such as may form a collet and/or other type of latching mechanism. Each flexible member 812 may have an exterior profile that corresponds to an interior profile of the inward-protruding portion 770. Thus, the exterior profile of each flexible member 812 may be mated with or otherwise be in engagement with the interior profile of the inward-protruding portion 770 of the mandrel 760. The first and second engagement features 810 and 770, and/or one or more aspects of their engagement, may be substantially similar or identical to those described above, with the possible exceptions being differences noted in the figures.

When the first and second engagement features 810 and 770 are engaged, and the release member 790 is in the first position, an end of the release member 790 interposes ends of the flexible members 812 of the first engagement feature 810, such that contact between an outer surface of the release member 790 and an inner surface of the flexible members 812 prevents disengagement of the first engagement feature 810 from the second engagement feature 770. That is, the positioning of the release member 790 within the end of the first engagement feature 810 prevents the inward deflection of the ends of the flexible members 812, thus preventing the axial separation of the first and second portions of the downhole tool 600.

However, when the release member 790 is repositioned to the second position, such that the release member 790 no longer protrudes into the end of the first engagement feature 810, the release member 790 does not prevent disengagement of the first and second engagement features 810 and 770. Accordingly, a tensile force acting on the second portion of the downhole tool 600, such as in response to a pull load applied to the downhole tool 600 and/or other portion of the tool string via the conveyance means 105, will disengage the first and second engagement features 810 and 770. Consequently, the first and second portions of the downhole tool 600 will axially separate.

Depending on the tensile force acting on the second portion of the downhole tool 600, the axial separation of the first and second portions may be quite rapid. However, the impact features 780 and 850 will limit the axial separation when they impact one another. The force of the impact, which depends on the tensile force acting across the downhole tool 600, is then imparted to a remaining portion of the tool string, via the interface 845 and similar interfaces between components of the tool string below (i.e., deeper in the wellbore) the downhole tool 600.

The imparted impact force may be utilized to aid in dislodging a portion of the tool string that has become stuck in the wellbore. However, if the impact force fails to dislodge the stuck portion of the tool string, the downhole tool 600 may be reset. That is, the pull load applied to the downhole tool 600 and/or other portion of the tool string via the conveyance means 105 may be decreased, thus allowing the axial separation of the first and second portions of the downhole tool 600 to decrease. The relative axial translation of the first and second engagement features 810 and 770 also axially displaces the release member 790 relative to the second portion of the downhole tool 600. After a sufficient decrease of the axial separation of the first and second portions of the downhole tool 600, the first and second engagement features 810 and 770 may reengage. Such reengagement decreases or eliminates the inward deflection of the ends of the flexible members 812 of the first engagement feature 810, thus permitting the release member 790 to once again be repositioned to the first position, as shown in FIG. 7. Such repositioning to the first position may be in response to an electronic signal transmitted via the conveyance means 105. Alternatively, or additionally, one or more springs and/or other mechanical and/or electrical biasing features 792 may be utilized in the repositioning of the release member 790 to the first position.

As described above, the release member 790 may be translated between the first and second positions in response to the downhole tool 600 receiving an electronic signal sent from surface via the conveyance means 105. The second portion of the downhole tool 600 may comprise or otherwise carry an actuator 900 operable to reposition the release member 790 between the first and second positions in response to the signal. In the example implementation shown in FIG. 7, the actuator 900 comprises an electric motor 910 operable to rotate a rotary member 920. The rotary member 920 is threadedly coupled to a rod 930, which is keyed to the housing connector 720 and/or otherwise prevented from rotating but permitted to axially translate. The rod 930 is coupled to the release member 790. Rotation of the electric motor 910 is imparted to the rotary member 920. Rotation of the rotary member 920 imparts axial movement of the rod 730, due to the threaded coupling thereof. The axial movement of the rod 730 is imparted to the release member 790. Thus, by selectively controlling the electric motor 910, the release member 790 may be translated axially between the first and second positions. After an impact cycle, the electric motor 910 may be operated in the reverse direction to reinsert the release member 790 into the end of the first engagement feature 810.

The electronic signal may be transmitted from surface via the conveyance means 105 (and perhaps other intervening components of the tool string) to a receiver associated with the actuator 900 and/or other electronics 940 of the downhole tool 600. If such signal is transmitted to the downhole tool 600 for the purpose of triggering the downhole tool 600 to perform an impact, the downhole tool 600 may already be under tension as a result of a pull load being maintained at a predetermined threshold on the conveyance means 105 at surface. In such scenario, the signal received by the receiver of the actuator 900 and/or other electronics 940 of the downhole tool 600 may be to cause the actuator 900 and/or other component of the downhole tool 600 to axially translate the release member 790 towards or to the second position, which in turn allows the rapid axial separation of the first and second portions of the downhole tool 600 to cause the desired impact. Thereafter, the pull load may be decreased, allowing the reengagement of the first and second engagement features 810 and 770. A subsequent signal may then be transmitted to the downhole tool 600 to cause the actuator 900 and/or other component of the downhole tool 600 to axially translate the release member 790 towards or to the first position, as shown in FIG. 7. This cycle may be repeated as necessary to dislodge the stuck portion of the tool string.

In some implementations, successive cycles may utilize a higher predetermined tension maintained by the pull load on the conveyance means 105 at surface. For example, successive cycles may utilize a predetermined tension that is about 5-10% higher than a preceding cycle. However, other intervals are also within the scope of the present application, and multiple cycles may be performed at individual predetermined tension levels.

Figure 12:
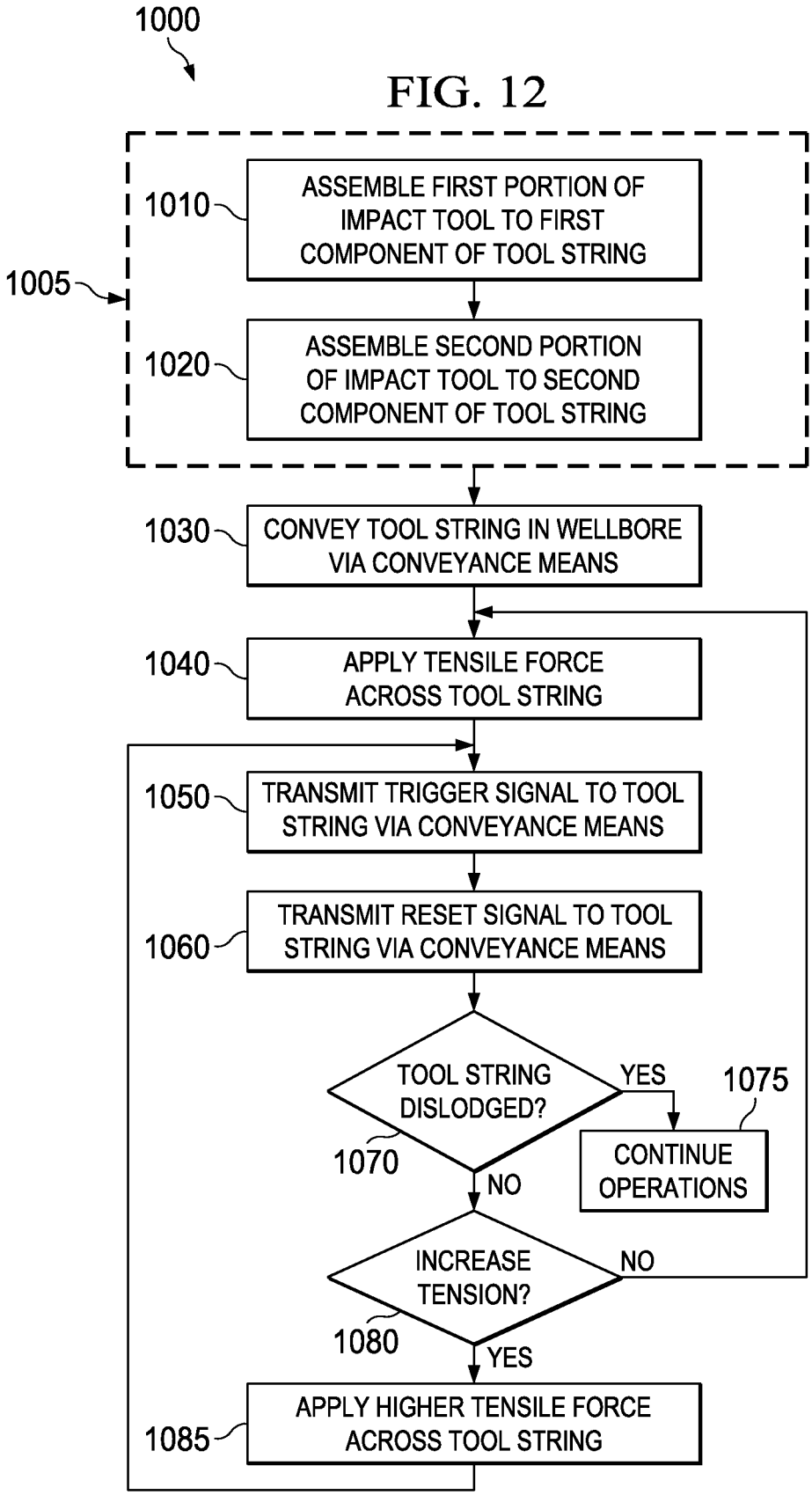
FIG. 12 is a flow-chart diagram of at least a portion of a method according to one or more aspects of the present disclosure.

FIG. 12 is a flow-chart diagram of at least a portion of a method (1000) according to one or more aspects of the present disclosure. The method (1000) is one example of many within the scope of the present disclosure which may be executed at least in part within the environment depicted in FIG. 1 and/or utilizing apparatus having one or more aspects in common with the downhole tool 200 shown in FIGS. 2-5 and/or the downhole tool 600 shown in FIGS. 6-11.

The method (1000) initially comprises assembling (1005) a tool string conveyable via conveyance means within a wellbore penetrating a subterranean formation. Assembling the tool string may comprise assembling (1010) a first portion of an impact apparatus to a first component of the tool string and assembling (1020) a second portion of the impact apparatus to a second component of the tool string. The first and second portions of the impact apparatus may be substantially similar or identical to the example implementations described above and/or otherwise within the scope of the present disclosure. For example, the first portion may comprise a first engagement feature and a first impact feature, and the second portion may comprise: (1) a second engagement feature in selectable engagement with the first engagement feature; (2) a second impact feature positioned to impact the first impact feature in response to disengagement of the first and second engagement features and a tensile force applied to one of the first and second tool string components by the conveyance means; and (3) a release member positionable between first and second positions in response to a signal carried by the conveyance means, wherein the release member prevents disengagement of the first and second engaging features when in the first position but not the second position.

The method (1000) may further comprise conveying (1030) the tool string via the conveyance means within the wellbore. Should the tool string or a component thereof become lodged in the wellbore, the method (1000) may further comprise applying (1040) the tensile force to one of the first and second tool string components and/or otherwise across the impact apparatus and/or tool string. Thereafter, the signal is transmitted (1050) to the tool string via the conveyance means. Applying the tensile force may comprise increasing a pull load on the conveyance means to a predetermined threshold (i.e., from a smaller load) and maintaining the pull load at the predetermined threshold while the signal is transmitted to the tool string, such that the release member is repositioned from the first position to the second position, the first and second engagement members disengage, and the first and second impact features impact.

The method (1000) may further comprise reducing the pull load a sufficient amount for the first and second engagement members to reengage, and then transmitting (1060) a reset signal and/or otherwise adjusting the signal transmitted to the tool string. Such reset/adjustment may cause the repositioning of the release member from the second position to the first position.

If the tool string is determined (1070) to have been dislodged, then normal operations may be continued (1075). If the tool string is determined (1070) to have not been dislodged, then the method (1000) may include the option (1080) of increasing the predetermined tension at which the next impact is to be triggered. If no increase is desired, the original tensile force may again be applied (1040), and the trigger signal may again be transmitted (1050) to the tool string. If an increase is desired, the increased tensile force may be applied (1085), and the trigger signal may again be transmitted (1050). Either cycle may be continued until it is determined (1070) that the tool string has been dislodged.

Figure 13:
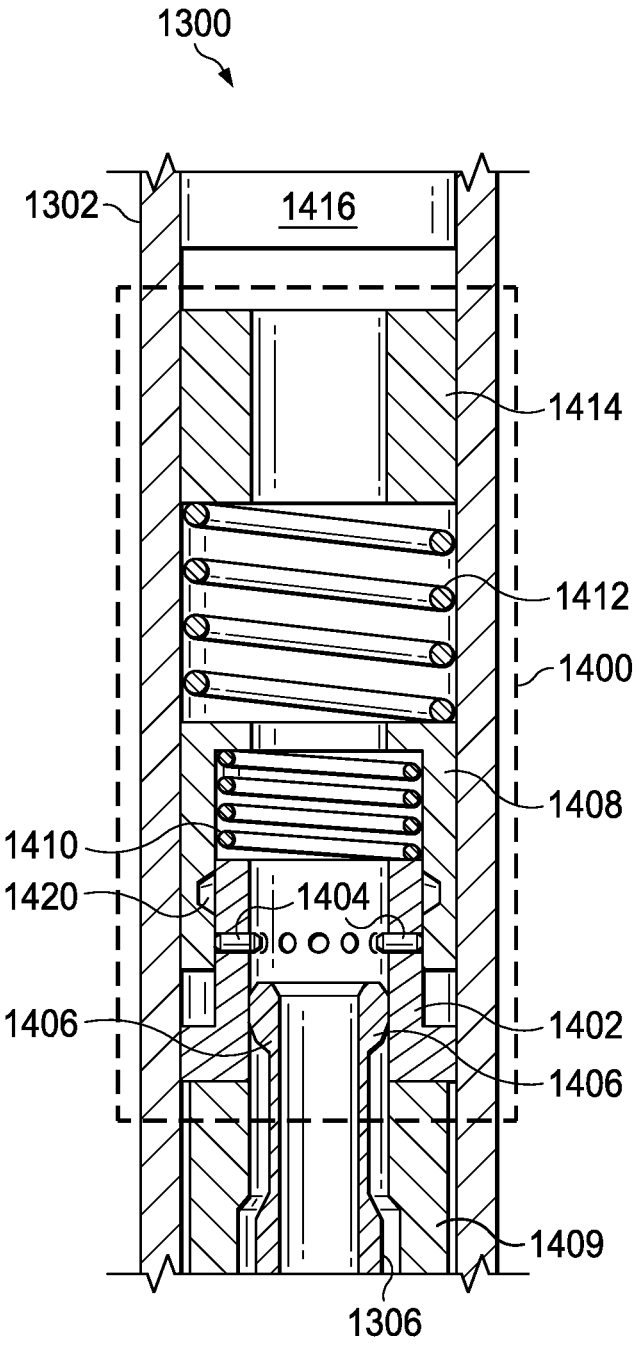
FIG. 13 is a sectional view of a portion of another implementation of the apparatus shown in FIG. 1 according to one or more aspects of the present disclosure.
Figure 14:
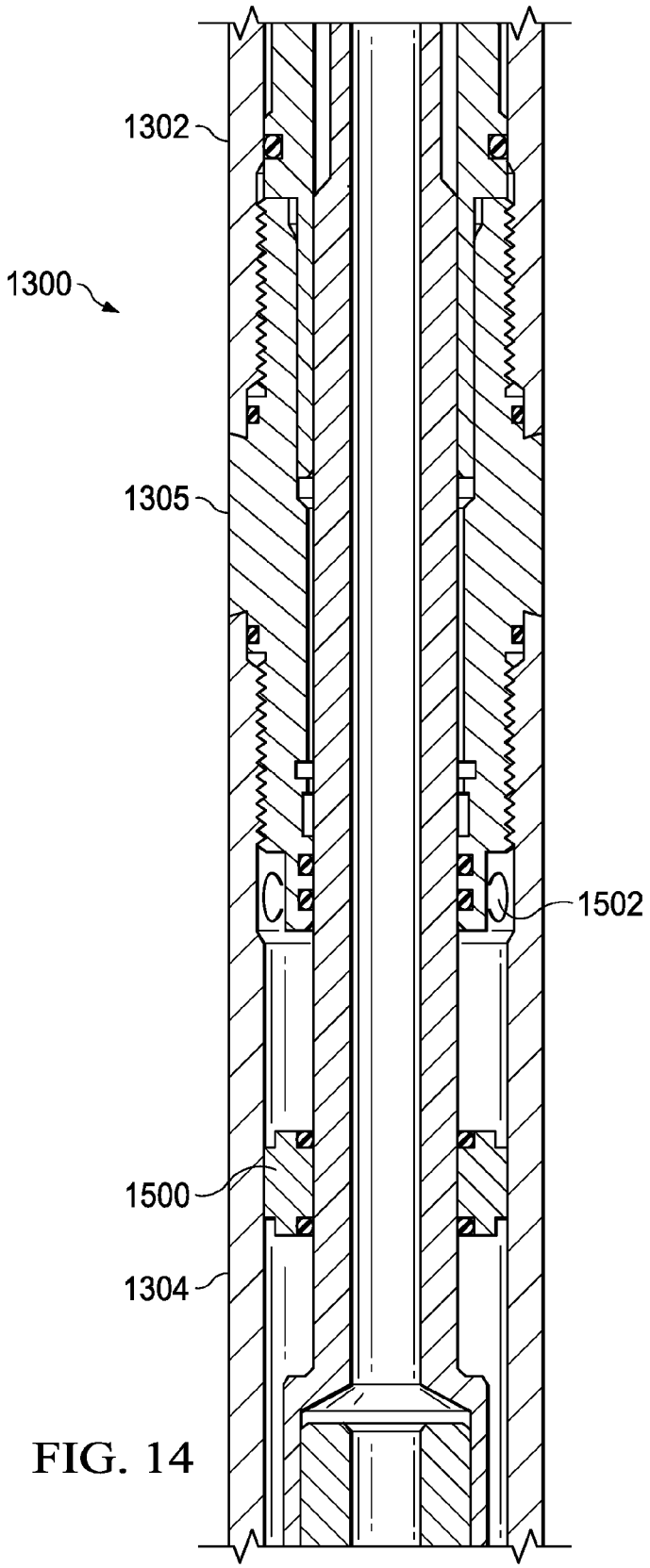
FIG. 14 is a sectional view of another portion of the apparatus shown in FIG. 13 according to one or more aspects of the present disclosure.
Figure 15:
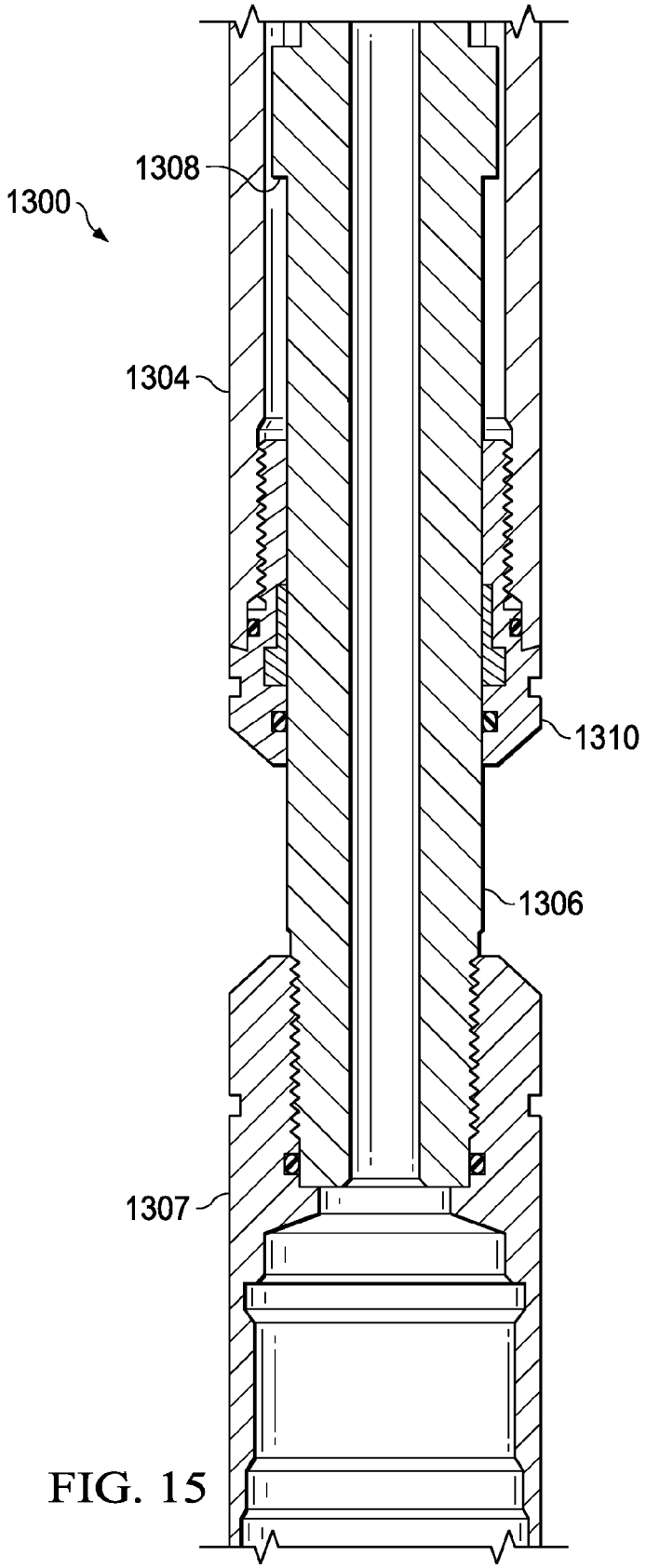
FIG. 15 is a sectional view of another portion of the apparatus shown in FIGS. 13 and 14 according to one or more aspects of the present disclosure.

FIGS. 13-15 are schematic views of at least a portion of another implementation of the apparatus 600 shown in FIGS. 6-11, herein designated by reference numeral 1300. The apparatus 1300 may have one or more aspects in common with the apparatus 600. The apparatus 1300 may, in fact, be substantially similar to the apparatus 600, with the possible exception of one or more aspects described below.

The apparatus 1300 is (or comprises) an electromagnetically activated downhole jar. The apparatus 1300 may comprise a body, such as may include an upper section 1302 and a lower sub section 1304 coupled on opposing sides of a connector 1305. An extensible rod 1306 is moveable axially within the upper and lower sections 1302 and 1304. An end of the rod 1306 may have a connector 1307 attached thereto, such as may create an extensible joint between the end connector 1307 and the upper section 1302. A stop 1310, such as may be provided on an end of the lower section 1304, may aid in retaining the rod 1306. The rod 1306 may also include or otherwise provide an inner shoulder 1308 for producing a jarring impact upon abrupt contact with the stop 1310. In a manner similar to that described above, a tensile force may be applied to the apparatus 1300, and the apparatus 1300 may be selectively activated to release the tension, extend the rod 1306, and create an impact that may be used to free stuck tools connected in a tool string comprising the apparatus 1300.

The apparatus 1300 may be selectively activated utilizing a resettable latch 1400. In FIG. 13, the apparatus 1300 is shown in an activated state such that the rod 1306 is free to extend through the stop 1310 and create a jarring impact. The latch 1400 includes a latch pin retainer 1402 containing a number of latch pins 1404 arranged in a radial fashion. Two of the latch pins 1404 are depicted in FIG. 13, but merely for the sake of simplicity, as any number of latch pins 1404 may be utilized. An upper portion of the rod 1306 defines or otherwise includes a mandrel 1406 that interacts with the latch pins 1404 as explained below. To exercise control over operation of the latch pins 1404, a release sleeve 1408 partially surrounds the latch pin retainer 1402. The latch pin retainer 1402 and the release sleeve 1408 have a degree of movement or freedom within the apparatus 1300. An adjacent electromagnetic (EM) release module 1414 and an internal stop 1409 limit the degree of such travel of the latch pin retainer 1402 and the release sleeve 1408. The EM release module 1414 and the internal stop 1409 may be fixed with respect to the upper section 1302.

A spring 1412 interposes the EM release module 1414 and the release sleeve 1408, and/or otherwise urges the release sleeve 1408 axially away from the EM release module 1414. An additional spring 1410 urges the latch pin retainer 1402 axially away from the release sleeve 1408. In the orientation depicted in FIG. 13, the latch pin retainer 1402, the release sleeve 1408, and the springs 1410 and 1412 are shown in the same position they would be if the apparatus 1300 were latched. However, it will be appreciated that, given the position of the rod 1306 and the mandrel 1406, the apparatus 1300 is not actually latched in the illustrated orientation.

That is, when the apparatus 1300 is in a latched configuration, the mandrel 1406 will be on the opposite side of the latch pins 1404 from what is shown in FIG. 13. To move from the unlatched position (shown) to the latched position (not shown), the end connector 1307 may be urged with compressive forces (e.g., by reducing tension across the apparatus 1300) toward the upper section 1302 of the body, or vice versa. The mandrel 1406 will move into contact with the latch pins 1404, which will urge the latch pin retainer 1402 further into the release sleeve 1408 against the force of the spring 1410 and/or the spring 1412. When the latch pin retainer 1402 has been compressed into the release sleeve 1408 by a sufficient amount, the latch pins 1404 will encounter a radial recess 1420 defined in an interior profile of the release sleeve 1408. The mandrel 1406 will then force the latch pins 1404 into the radial recess 1420, which will allow the mandrel 1406 to pass by the latch pins 1404. When the compressive forces on the apparatus 1300 are abated, the latch pin retainer 1402 and the release sleeve 1408 will return to the position shown in FIG. 13, but the mandrel 1406 will be on the opposite side of the latch pins 1404, and will thus be prevented from being withdrawn. Once the apparatus 1300 is in a latched position, it will be able to withstand a substantial tensile force without extending.

An electronic control module 1416 may be provided within the upper section 1302. The electronic control module 1416 may receive communication signals from an operator that indicate when the EM release module 1414 is to be activated. The apparatus 1300 may be a wireline, slickline or e-line tool, depending upon the particular configuration and/or needs of the user. In cases where the apparatus 1300 is an e-line tool, a conductor in the work string comprising the apparatus 1300 may carry an activation signal to the EM release module 1414 and/or other component of the apparatus 1300 and/or work string. Where the apparatus 1300 is configured as a slickline tool, it may be activated wirelessly (where range permits) or via a safe voltage applied directly to the work string comprising the apparatus 1300. The apparatus 1300 may also or instead be controlled by mud or fluid pulses in the well bore.

When the electronic control module 1416 receives an activation signal, the EM release module 1414 may be energized to draw the release sleeve 1408 away from the latch pin retainer 1402. The EM release module 1414 may be or comprise an electromagnet providing sufficient force to draw the release sleeve 1408 toward the EM release module 1414, overcoming the force of the spring 1412. Once the release sleeve 1408 has been drawn away from the latch pin retainer 1402 a sufficient amount, the latch pins 1404 will be free to extend radially into the space vacated by the release sleeve 1408. The mandrel 1406 will force the latch pins 1404 aside and therefore be free to extend along with the rod 1306. As previously described, the amount of tensile forces stored within the work string may be quite substantial and will actually pull the upper section 1302 and the lower section 1304 away from the lower connector 1307. When the rod 1306 has extended through the stop 1310 a sufficient amount, a high force impact will be created between the stop 1310 and the inner shoulder 1308. This impact will create an abrupt upward jarring motion on whatever portion of work string is below the lower connector 1307. This impact may be useful for freeing stuck tools and the like.

Following the jarring impact, the apparatus 1300 may be reset in place. For example, the EM release module 1414 may be deactivated, allowing the release sleeve 1408 and the latch pin retainer 1402 to return to the orientation shown in FIG. 13. As previously described, compressive forces may be applied on the work string which will drive the rod 1306 back into the upper section 1302 with the mandrel 1406 displacing the latch pins 1404 into the radial recess 1420, allowing the apparatus 1300 to reset or relatch.

The apparatus 1300 may also comprise a pressure-equalizing piston 1500 surrounding a portion of the rod 1306. A number of ports 1502 may also be defined in the lower section 1304. As the internal volume of the apparatus 1300 changes due to activation or resetting, the pressure-equalizing piston 1500 is free to move to expel or ingest additional wellbore fluid into the space defined between the piston 1500 and the ports 1502. Thus, the pressure within the apparatus 1300 may substantially match the pressure outside the apparatus 1300, which may aid in preventing leaks or contamination of internal lubrication of the apparatus 1300. Pressure equalization may also aid in preventing hydraulic locking of the apparatus 1300 due to pressure differentials acting across seals.

In view of the entirety of the present disclosure, including the appended figures and the claims set forth below, a person having ordinary skill in the art should readily recognize that the present disclosure introduces an apparatus comprising an impact apparatus conveyable in a tool string via conveyance means within a wellbore extending into a subterranean formation. The impact apparatus comprises a first portion and a second portion. The first portion comprises a first interface for coupling with a first downhole apparatus, a first engagement feature, and a first impact feature. The second portion comprises: a second interface for coupling with a second downhole apparatus; a second engagement feature in selectable engagement with the first engagement feature; a second impact feature positioned to impact the first impact feature in response to disengagement of the first and second engagement features and a tensile force applied to one of the first and second downhole apparatus by the conveyance means; and a release member positionable between first and second positions in response to a signal carried by the conveyance means, wherein the release member prevents disengagement of the first and second engaging features when in the first position but not the second position.

The first and second interfaces may be for threadedly coupling with the first and second downhole apparatus, respectively.

The selectable engagement of the first and second engagement features may comprise engagement of an outer surface of the first engagement feature and an inner surface of the second engagement feature. An outer surface of the release member may contact an inner surface of the first engagement feature when the release member is in the first position. The outer surface of the release member may not contact the inner surface of the first engagement feature when the release member is in the second position.

The first engagement feature may comprise a plurality of flexible members each having a first profile, and the second engagement member may comprise a substantially annular member having an inner surface, wherein the inner surface may have a second profile substantially corresponding to the first profile. The release member may contact an inner surface of at least one of the plurality of flexible members when in the first position. The release member may not contact the inner surface of any of the plurality of flexible members when in the second position.

The second portion may further comprise an actuator operable to reposition the release member between the first and second positions in response to the signal. The actuator may comprise an electronic solenoid switch.

The second portion may further comprise: an actuator operable to reposition the release member from the first position to the second position; and a mechanical, electrical, electromechanical, magnetic, or electromagnetic biasing member operable to reposition the release member from the second position to the first position.

The first and second impact features may comprise substantially parallel features carried by the first and second portions, respectively. The substantially parallel features may be substantially perpendicular to a longitudinal axis of the impact apparatus.

The impact apparatus may further comprise an electrical conductor extending through passages of each of the first and second interfaces, the first and second engagement features, and the release member.

The apparatus may further comprise the first and second downhole apparatus.

The present disclosure also introduces a method comprising assembling a tool string conveyable via conveyance means within a wellbore penetrating a subterranean formation, wherein assembling the tool string comprises: assembling a first portion of an impact apparatus to a first component of the tool string, wherein the first portion comprises: a first engagement feature; and a first impact feature; and assembling a second portion of the impact apparatus to a second component of the tool string, wherein the second portion comprises: a second engagement feature in selectable engagement with the first engagement feature; a second impact feature positioned to impact the first impact feature in response to disengagement of the first and second engagement features and a tensile force applied to one of the first and second tool string components by the conveyance means; and a release member positionable between first and second positions in response to a signal carried by the conveyance means, wherein the release member prevents disengagement of the first and second engaging features when in the first position but not the second position.

The method may further comprise: conveying the tool string via the conveyance means within the wellbore; applying the tensile force to one of the first and second tool string components; and transmitting the signal to the tool string via the conveyance means. Applying the tensile force may comprises: increasing a pull load on the conveyance means to a predetermined threshold, from a smaller load; and maintaining the pull load at the predetermined threshold while the signal is transmitted to the tool string and the release member is subsequently repositioned from the first position to the second position, wherein the first and second engagement members disengage and the first and second impact features impact. The method may further comprise: reducing the pull load a sufficient amount for the first and second engagement members to reengage; and adjusting the signal transmitted to the tool string to reposition the release member from the second position to the first position. The predetermined threshold may be a first predetermined threshold, and the method may further comprise: after the first and second engagement members are again engaged, increasing the pull load on the conveyance means to a second predetermined threshold that is substantially greater than the first predetermined threshold; and maintaining the pull load at the second predetermined threshold while the signal is again transmitted to the tool string and the release member is again repositioned from the first position to the second position.

The present disclosure also introduces an apparatus comprising: an impact apparatus conveyable in a tool string within a wellbore extending into a subterranean formation, wherein the impact apparatus comprises: a first portion comprising a mandrel and a first impact feature; and a second portion, comprising: a latch pin retainer comprising an annular portion encircling an end of the mandrel and defining an inner surface and an outer surface; a release sleeve housing a portion of the latch pin retainer, wherein an inner profile of an annular portion of the release sleeve includes a radial recess;

a plurality of latch pins each slidable within a corresponding passage extending between the inner and outer surfaces of the latch pin retainer annular portion, including between an inner position, in which the latch pins prevent passage of the mandrel end, and an outer position, permitting passage of the mandrel end, wherein the radial recess of the release sleeve receives ends of the latch pins in the outer position; an electromagnetic release member operable to electromagnetically cause relative translation of the latch pin retainer and the release sleeve, including to axially align the latch pins with the radial recess of the release sleeve to permit the latch pins to move from the inner position to the outer position; and a second impact feature positioned to impact the first impact feature in response to disengagement of the mandrel end from the latch pin retainer and a tensile force applied across the impact apparatus.

Each latch pin may: protrude inward from the inner surface of the latch pin retainer annular portion when in the inner position, thereby preventing passage of the mandrel end past the plurality of latch pins; and protrude outward from the outer surface of the latch pin retainer annular portion, including into the radial recess of the release sleeve, when in the outer position, thereby permitting passage of the mandrel end past the plurality of latch pins. Each latch pin may not protrude: inward from the inner surface of the latch pin retainer annular portion when in the outer position; and outward from the outer surface of the latch pin retainer annular portion when in the inner position.

The apparatus may further comprise a spring biasing the latch pin retainer out of the release sleeve.

The apparatus may further comprise a spring biasing the retainer sleeve away from the electromagnetic release member.

The tool string may further comprise a first apparatus and a second apparatus. The first portion may further comprise a first interface for coupling with the first apparatus, and the second portion may further comprise a second interface for coupling with the second apparatus. The first and second interfaces may be for threadedly coupling with the first and second apparatus, respectively.

The first and second impact features may comprise substantially parallel features carried by the first and second portions, respectively, and the substantially parallel features may be substantially perpendicular to a longitudinal axis of the impact apparatus.

The present disclosure also introduces an apparatus comprising: an impact apparatus positioned in a subterranean wellbore and comprising: a mandrel; a first impact feature; a latch pin retainer encircling an end of the mandrel; a release sleeve encircling a portion of the latch pin retainer and having a radial recess; a plurality of latch pins retained by the latch pin retainer, slidable into and out of the radial recess, and preventing disengagement of the mandrel end from the latch pin retainer when the latch pins are not extending into the radial recess; a release member operable to electromagnetically cause relative translation of the latch pin retainer and the release sleeve, including to align the latch pins with the radial recess and thereby permit the disengagement; and a second impact feature positioned to impact the first impact feature in response to the disengagement when the impact apparatus is under tension.

The apparatus may further comprise a spring biasing the latch pin retainer away from the release sleeve.

The apparatus may further comprise a spring biasing the retainer sleeve away from the release member.

The impact apparatus may form a portion of a tool string further comprising a first apparatus and a second apparatus, and the impact apparatus may further comprise: a first interface for coupling with the first apparatus; and a second interface for coupling with the second apparatus. The first and second interfaces may be for threadedly coupling with the first and second apparatus, respectively.

The first and second impact features may comprise substantially parallel features, and the substantially parallel features may be substantially perpendicular to a longitudinal axis of the impact apparatus.

The present disclosure also introduces a method comprising: assembling a tool string conveyable within a subterranean wellbore, wherein assembling the tool string comprises: assembling a first portion of an impact apparatus to a first component of the tool string, wherein the first portion comprises a mandrel and a first impact feature; and assembling a second portion of the impact apparatus to a second component of the tool string, wherein the second portion comprises: a latch pin retainer comprising an annular portion encircling an end of the mandrel and defining an inner surface and an outer surface; a release sleeve housing a portion of the latch pin retainer, wherein an inner profile of an annular portion of the release sleeve includes a radial recess; a plurality of latch pins each slidable within a corresponding passage extending between the inner and outer surfaces of the latch pin retainer annular portion, including between an inner position, in which the latch pins prevent passage of the mandrel end, and an outer position, permitting passage of the mandrel end, wherein the radial recess of the release sleeve receives ends of the latch pins in the outer position; an electromagnetic release member operable to receive an electronic signal and consequently electromagnetically cause relative translation of the latch pin retainer and the release sleeve, including to axially align the latch pins with the radial recess of the release sleeve to permit the latch pins to move from the inner position to the outer position; and a second impact feature positioned to impact the first impact feature in response to disengagement of the mandrel from the latch pin retainer and a tensile force applied across the impact apparatus.

The method may further comprise: assembling the first portion; assembling the second portion; and assembling the first and second portions to each other.

The method may further comprise: conveying the tool string within the wellbore via a conveyance means; applying the tensile force to one of the first and second tool string components; and transmitting the signal to the tool string via the conveyance means. Applying the tensile force may comprise: increasing a pull load on the conveyance means to a predetermined threshold; and maintaining the pull load at the predetermined threshold while the signal is transmitted to the tool string and the electromagnetic release member subsequently causes the relative translation of the latch pin retainer and the release sleeve, including to axially align the latch pins with the radial recess of the release sleeve to permit the latch pins to move from the inner position to the outer position and thereby permit disengagement of the mandrel end from the latch pin retainer. The method may further comprise: reducing the pull load a sufficient amount for the mandrel end and latch pins to reengage; and adjusting the signal transmitted to the tool string to undo the relative translation of the patch pin retainer and the release sleeve. The predetermined threshold may be a first predetermined threshold, and the method may further comprise: after the mandrel end and the latch pins are again engaged, increasing the pull load on the conveyance means to a second predetermined threshold that is substantially greater than the first predetermined threshold; and maintaining the pull load at the second predetermined threshold while the signal is again transmitted to the tool string to again cause the relative translation of the latch pin retainer and the release sleeve, including to axially align the latch pins with the radial recess of the release sleeve to permit the latch pins to move from the inner position to the outer position and thereby permit disengagement of the mandrel end from the latch pin retainer.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

an impact apparatus conveyable in a tool string within a wellbore extending into a subterranean formation, wherein the impact apparatus comprises:

a first portion comprising a mandrel and a first impact feature; and a second portion, comprising:

a latch pin retainer comprising an annular portion encircling an end of the mandrel and defining an inner surface and an outer surface;

a release sleeve housing a portion of the latch pin retainer, wherein an inner profile of an annular portion of the release sleeve includes a radial recess;

a plurality of latch pins each slidable within a corresponding passage extending between the inner and outer surfaces of the latch pin retainer annular portion, including between an inner position, in which the latch pins prevent passage of the mandrel end, and an outer position, permitting passage of the mandrel end, wherein the radial recess of the release sleeve receives ends of the latch pins in the outer position;

an electromagnetic release member operable to electromagnetically cause relative translation of the latch pin retainer and the release sleeve, including to axially align the latch pins with the radial recess of the release sleeve to permit the latch pins to move from the inner position to the outer position; and a second impact feature positioned to impact the first impact feature in response to disengagement of the mandrel end from the latch pin retainer and a tensile force applied across the impact apparatus.

2. The apparatus of claim 1 wherein each latch pin:

protrudes inward from the inner surface of the latch pin retainer annular portion when in the inner position, thereby preventing passage of the mandrel end past the plurality of latch pins; and protrudes outward from the outer surface of the latch pin retainer annular portion, including into the radial recess of the release sleeve, when in the outer position, thereby permitting passage of the mandrel end past the plurality of latch pins.

3. The apparatus of claim 2 wherein each latch pin does not protrude:

inward from the inner surface of the latch pin retainer annular portion when in the outer position; and outward from the outer surface of the latch pin retainer annular portion when in the inner position.

4. The apparatus of claim 1 further comprising a spring biasing the latch pin retainer out of the release sleeve.

5. The apparatus of claim 1 further comprising a spring biasing the retainer sleeve away from the electromagnetic release member.

6. The apparatus of claim 1 wherein the tool string further comprises a first apparatus and a second apparatus, the first portion further comprises a first interface for coupling with the first apparatus, and the second portion further comprises a second interface for coupling with the second apparatus.

7. The apparatus of claim 6 wherein the first and second interfaces are for threadedly coupling with the first and second apparatus, respectively.

8. The apparatus of claim 1 wherein the first and second impact features comprise substantially parallel features carried by the first and second portions, respectively, and wherein the substantially parallel features are substantially perpendicular to a longitudinal axis of the impact apparatus.

9. An apparatus, comprising:

an impact apparatus positioned in a subterranean wellbore and comprising:

a mandrel;

a first impact feature;

a latch pin retainer encircling an end of the mandrel;

a release sleeve encircling a portion of the latch pin retainer and having a radial recess;

a plurality of latch pins retained by the latch pin retainer, slidable into and out of the radial recess, and preventing disengagement of the mandrel end from the latch pin retainer when the latch pins are not extending into the radial recess;

a release member operable to electromagnetically cause relative translation of the latch pin retainer and the release sleeve, including to align the latch pins with the radial recess and thereby permit the disengagement; and a second impact feature positioned to impact the first impact feature in response to the disengagement when the impact apparatus is under tension.

10. The apparatus of claim 9 further comprising a spring biasing the latch pin retainer away from the release sleeve.

11. The apparatus of claim 9 further comprising a spring biasing the retainer sleeve away from the release member.

12. The apparatus of claim 9 wherein the impact apparatus forms a portion of a tool string further comprising a first apparatus and a second apparatus, and wherein the impact apparatus further comprises:

a first interface for coupling with the first apparatus; and a second interface for coupling with the second apparatus.

13. The apparatus of claim 12 wherein the first and second interfaces are for threadedly coupling with the first and second apparatus, respectively.

14. The apparatus of claim 9 wherein the first and second impact features comprise substantially parallel features, and wherein the substantially parallel features are substantially perpendicular to a longitudinal axis of the impact apparatus.

15. A method, comprising:

assembling a tool string conveyable within a subterranean wellbore, wherein assembling the tool string comprises:

assembling a first portion of an impact apparatus to a first component of the tool string, wherein the first portion comprises a mandrel and a first impact feature; and assembling a second portion of the impact apparatus to a second component of the tool string, wherein the second portion comprises:

a latch pin retainer comprising an annular portion encircling an end of the mandrel and defining an inner surface and an outer surface;

a release sleeve housing a portion of the latch pin retainer, wherein an inner profile of an annular portion of the release sleeve includes a radial recess;

a plurality of latch pins each slidable within a corresponding passage extending between the inner and outer surfaces of the latch pin retainer annular portion, including between an inner position, in which the latch pins prevent passage of the mandrel end, and an outer position, permitting passage of the mandrel end, wherein the radial recess of the release sleeve receives ends of the latch pins in the outer position;

an electromagnetic release member operable to receive an electronic signal and consequently electromagnetically cause relative translation of the latch pin retainer and the release sleeve, including to axially align the latch pins with the radial recess of the release sleeve to permit the latch pins to move from the inner position to the outer position; and a second impact feature positioned to impact the first impact feature in response to disengagement of the mandrel from the latch pin retainer and a tensile force applied across the impact apparatus.

16. The method of claim 15 further comprising:

assembling the first portion;

assembling the second portion; and assembling the first and second portions to each other.

17. The method of claim 15 further comprising:

conveying the tool string within the wellbore via a conveyance means;

applying the tensile force to one of the first and second tool string components; and transmitting the signal to the tool string via the conveyance means.

18. The method of claim 17 wherein applying the tensile force comprises:

increasing a pull load on the conveyance means to a predetermined threshold; and maintaining the pull load at the predetermined threshold while the signal is transmitted to the tool string and the electromagnetic release member subsequently causes the relative translation of the latch pin retainer and the release sleeve, including to axially align the latch pins with the radial recess of the release sleeve to permit the latch pins to move from the inner position to the outer position and thereby permit disengagement of the mandrel end from the latch pin retainer.

19. The method of claim 18 further comprising:

reducing the pull load a sufficient amount for the mandrel end and latch pins to reengage; and adjusting the signal transmitted to the tool string to undo the relative translation of the patch pin retainer and the release sleeve.

20. The method of claim 19 wherein the predetermined threshold is a first predetermined threshold, and wherein the method further comprises:

after the mandrel end and the latch pins are again engaged, increasing the pull load on the conveyance means to a second predetermined threshold that is substantially greater than the first predetermined threshold; and maintaining the pull load at the second predetermined threshold while the signal is again transmitted to the tool string to again cause the relative translation of the latch pin retainer and the release sleeve, including to axially align the latch pins with the radial recess of the release sleeve to permit the latch pins to move from the inner position to the outer position and thereby permit disengagement of the mandrel end from the latch pin retainer.

* * * * *